US005906169A

United States Patent [19]

Martelli

[11] Patent Number: 5,906,169

[45] **Date of Patent: *May 25, 1999**

[54] BIAS BINDER SEWING AID FOR MACHINES

[76] Inventor: John D. Martelli, 321 S. 61st Ave., Pensacola, Fla. 32506

[ * ] Notice: This patent is subject to a terminal disclaimer.

[21] Appl. No.: 08/900,240

[22] Filed: Jul. 24, 1997

Related U.S. Application Data

[63] Continuation-in-part of application No. 29/069,275, Mar. 24, 1997.

[51] Int. Cl.[6] ..... D05B 35/06

[52] U.S. Cl. ..... 112/137; 112/147; 112/136

[58] Field of Search ..... 112/15, 20, 51, 112/470.16, 136, 475.06, 147, 137

[56] References Cited

U.S. PATENT DOCUMENTS

| | | | |
|---|---|---|---|
| 166,161 | 7/1875 | Trowbridge | 112/147 |
| 438,212 | 10/1890 | Wissler | 112/137 |
| 891,310 | 6/1908 | Wever | 112/137 |
| 1,157,384 | 10/1915 | Hansen | 112/136 |
| 1,489,217 | 4/1924 | Jones | 112/147 |
| 1,746,541 | 2/1930 | Loeb | D15/72 |
| 1,836,742 | 12/1931 | Auerbach | 112/136 |
| 2,319,191 | 5/1943 | Sailer | 112/136 |
| 3,096,735 | 7/1963 | Wise | 112/136 |
| 4,691,537 | 9/1987 | Cullen et al. | 66/172 R |

*Primary Examiner*—John J. Calvert
*Assistant Examiner*—Tejash D Patel
*Attorney, Agent, or Firm*—George A. Bode; Lisa D. Charouel; Bode & Associates

[57] ABSTRACT

A bias binder sewing aid which functions to receive fabric or the like having a predetermined width and automatically fold such fabric wherein the center of the width remains the center of such folded fabric The portion of the fabric to the left of the center is substantially folded in half along its center and the portion of the fabric to the right of the center is substantially folded in half along its center.

17 Claims, 7 Drawing Sheets

BIAS BINDER SEWING AID FOR MACHINES

This application is a continuation-in-part application of a previous application by the same inventor bearing U.S. Ser. No. 29/069,275 filed Mar. 24, 1997. The entirety of this previous application is incorporated herein by reference as if set forth in full below.

BACKGROUND OF THE INVENTION

1. Field of the Invention

The present invention relates to a bias binder sewing aid and, more particularly, to a bias binder sewing aid for use with sewing machines which automatically folds fabric without the need for pre-processing such as pre-folding, pinning, and/or ironing, thereby minimizing the amount of time to finish a garment, a quilt or the like.

2. General Background

In the sewing industry, garments have sewn thereto, boarders or a bias which allow free ends of such garments to be nicely finished. In the past such boarders and biases must be pre-processed such as, without limitation, pressed, folded and/or pinned, so that such boarders or biases may be easily sewn to the garment. However, if such pre-processing is foregone then such boarders or biases may be gapped during the sewing process rendering the garment, with such gapped boarder or biases, defective; and, as a result, profits are diminished.

Nevertheless, such pre-processing, which is required to produce quality garments, is costly. Therefore, several attempts have been made to eliminate such pre-processing.

SUMMARY OF THE PRESENT INVENTION

The preferred embodiment of the bias binder sewing aid of the present invention solves the aforementioned problems in a straight forward and simple manner. What is provided is a bias binder sewing aid for use with sewing machines which automatically folds fabric without the need for pre-processing such as pre-folding, pinning or ironing, thereby minimizing the amount of time to finish a garment, quilt or the like.

The bias binder sewing aid folds a piece of fabric having a predetermined width The bias binder sewing aid comprises:

(a) inlet port;

(b) fabric folding conduit, coupled to said inlet port, defined by a top surface and a bottom surface which are parallel and separated by an interior channel height, said fabric folding conduit comprises:

a left channel side which continuously curves inward toward a center of said fabric folding conduit wherein the width of said left channel side continuously widens toward said center and as said left channel side continuously curves inward, said top surface overlaps upon itself wherein said top surface becomes substantially parallel with itself, and a right channel side which continuously curves inward toward said center, wherein a right portion of said fabric folding conduit to the right of said center proceeds to continuously rise above a horizontal plane while simultaneously continuously curving to overlap upon said top surface wherein an overlapping wall is formed, and wherein as said right channel side continuously rises above the horizontal plane and simultaneously continuously curve, the width of said right channel side widens and said overlapping wall peaks, thereafter said overlapping wall proceeds to decrease in height and increase the amount of overlap over said left channel side; and, (c) an outlet port coupled to an end of said fabric folding conduit.

In operation, my bias binder sewing aid functions to receive fabric or the like having a predetermined width and automatically fold such fabric wherein the center of the width remains the center of such folded fabric. The portion of the fabric to the left of the center is substantially folded in half along its center and the portion of the fabric to the right of the center is substantially folded in half along its center.

In view of the above, it is an object of the present invention to provide a bias binder sewing aid which facilitates the attachment of a boarder or a bias to a garment, quilt or the like such that such boarder or bias is evenly folded. Moreover, the folded sides of such boarder or bias defines a V-shaped conduit for receiving therein an unfinished edge of said garment, quilt or the like.

Another object of the present invention is to provide a bias binder sewing aid which is easily coupled to a sewing machine.

A further object of the present invention to provide a bias binder sewing aid which allows a seamstress to easily and effortlessly feed material through a fabric folding conduit via at least one manual feeding channel.

In view of the above objects it is a feature of the present invention to provide a bias binder sewing aid which is easy to use.

It is another feature of the present invention to provide a bias binder sewing aid which is inexpensive to manufacture.

A further feature of the present invention is to provide a bias binder sewing aid made of a lightweight material such as plastic or plastic-like material.

The above and other objects and features of the present invention will become apparent from the drawings, the description given herein, and the appended claims.

BRIEF DESCRIPTION OF THE DRAWING

For a further understanding of the nature and objects of the present inventions reference should be had to the following description taken in conjunction with the accompanying drawings in which like parts are given like reference numerals and, wherein.

DETAILED DESCRIPTION OF THE PREFERRED EMBODIMENT

Figure 9:
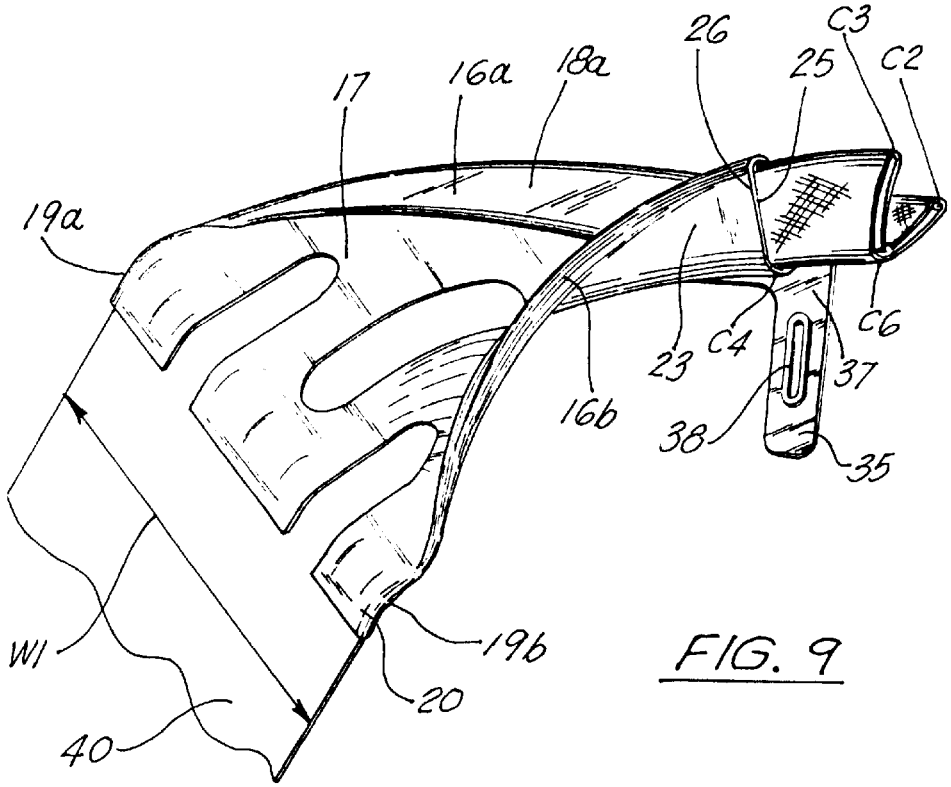
FIG. 9 illustrates my bias binder sewing aid for sewing machines having the perspective view of FIG. 7 and having fabric fully inserted therein.
Figure 10:
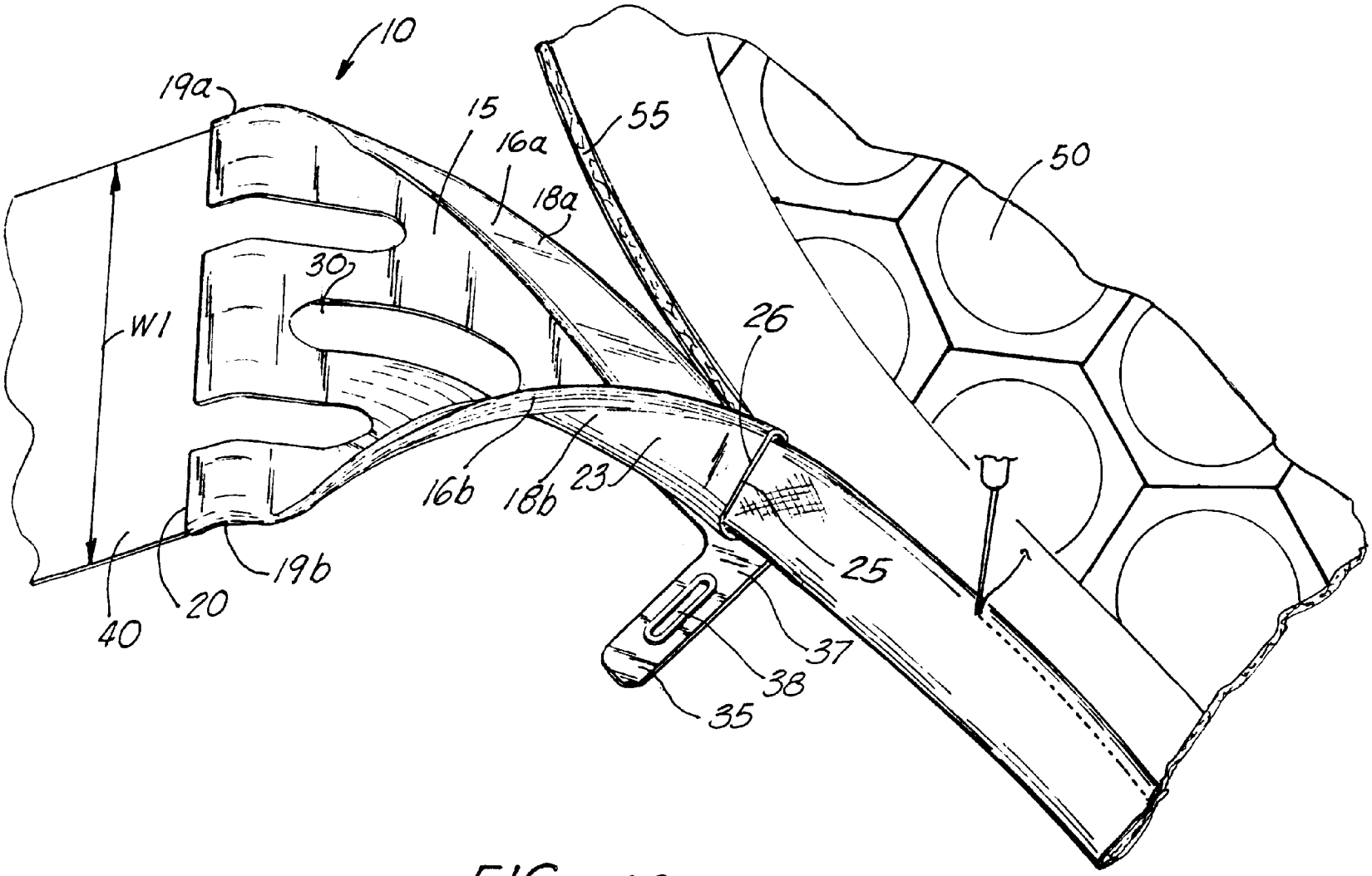
FIG. 10 illustrates my bias binder device in use.

Referring now to the drawing, and in particular FIG. 10, the bias binder sewing aid of the present invention is designated generally by the numeral 10. My bias binder sewing aid 10 functions to receive fabric 40 or the like having a predetermined width W1 and automatically fold such fabric 40, as best seen in FIG. 9, wherein the center C1 of width W1 remains the center of such folded fabric. In the preferred embodiment, the portion of the fabric to the left of center C1 is substantially folded in half along center C2 and the portion of fabric 40 to the right of center C1 is substantially folded in half along center C3. Nevertheless, in stead of folding the portion of fabric to the left in half along center C2, such portion may be folded along a line which is further left than center $C2_0$ Likewise, in order to maintain symmetry, the portion of the fabric to the right of center C1 may be folded along a line which is further right than center C3, by an equal amount. The folded sides of fabric 40 defines a V-shaped fabric conduit for receiving therein unfinished edge 55 of garment, quilt or the like 50.

Figure 1:
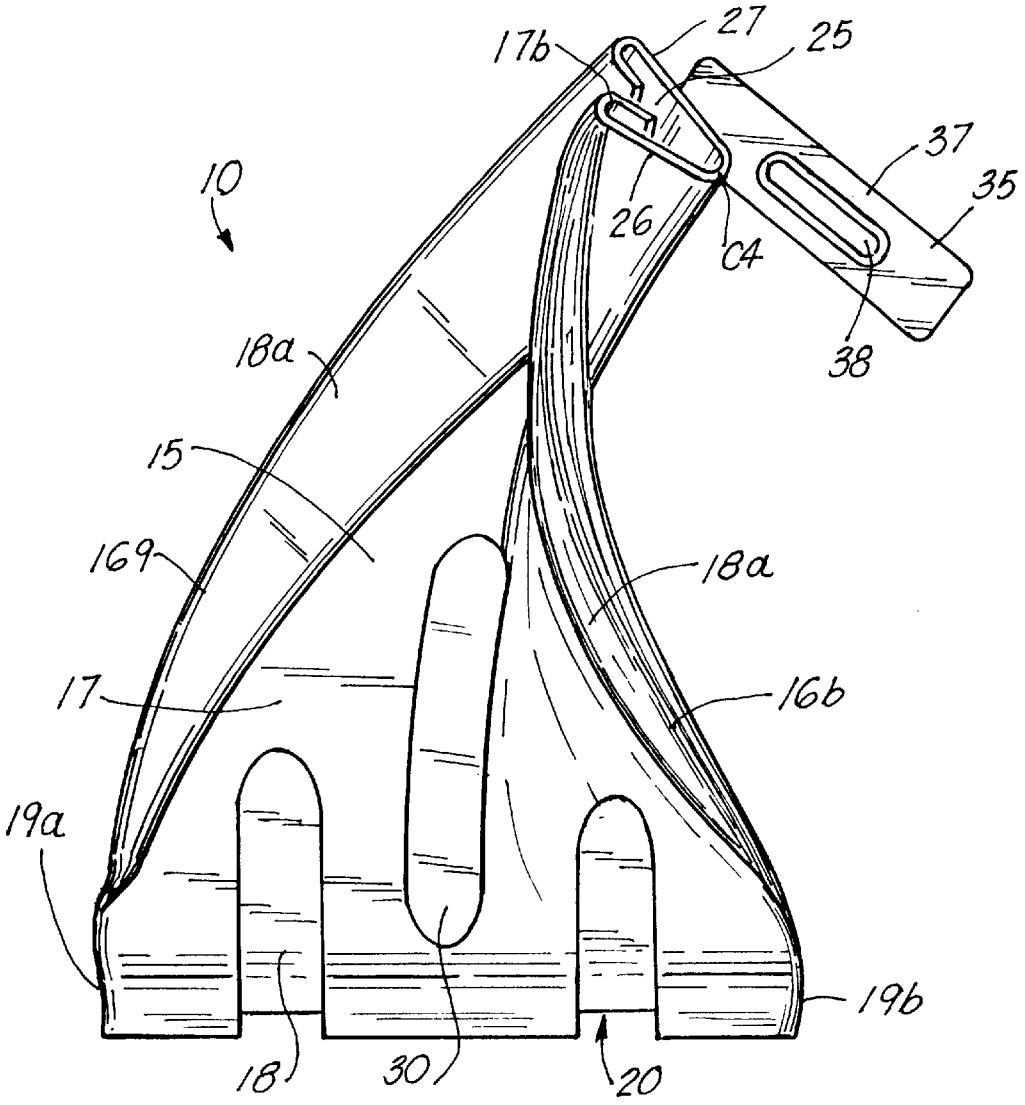
FIG. 1 is a top plan view of the preferred embodiment of my bias binder sewing aid for sewing machines, of the present inventions
Figure 7:
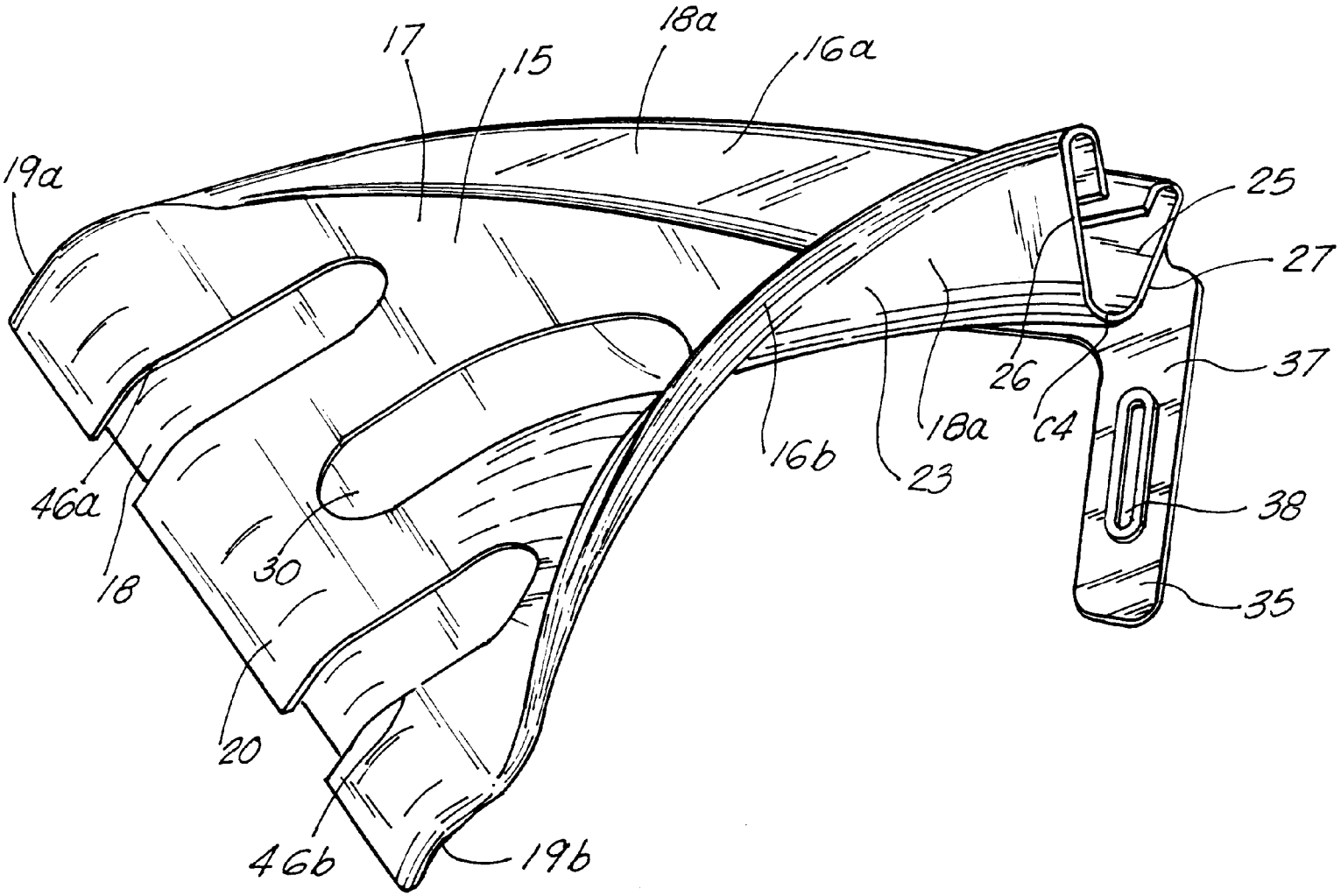
FIG. 7 is a top, front and right side perspective view of the embodiment of FIG. 1, taken at approximately 45 degrees above the horizontal plane.

Referring to FIGS. 1 and 7, bias binder sewing aid 10 is generally comprised of fabric folding conduit 15, inlet port 20, outlet port 25, at least one manual feeding channel 30 and machine attaching means 35.

Figure 8:
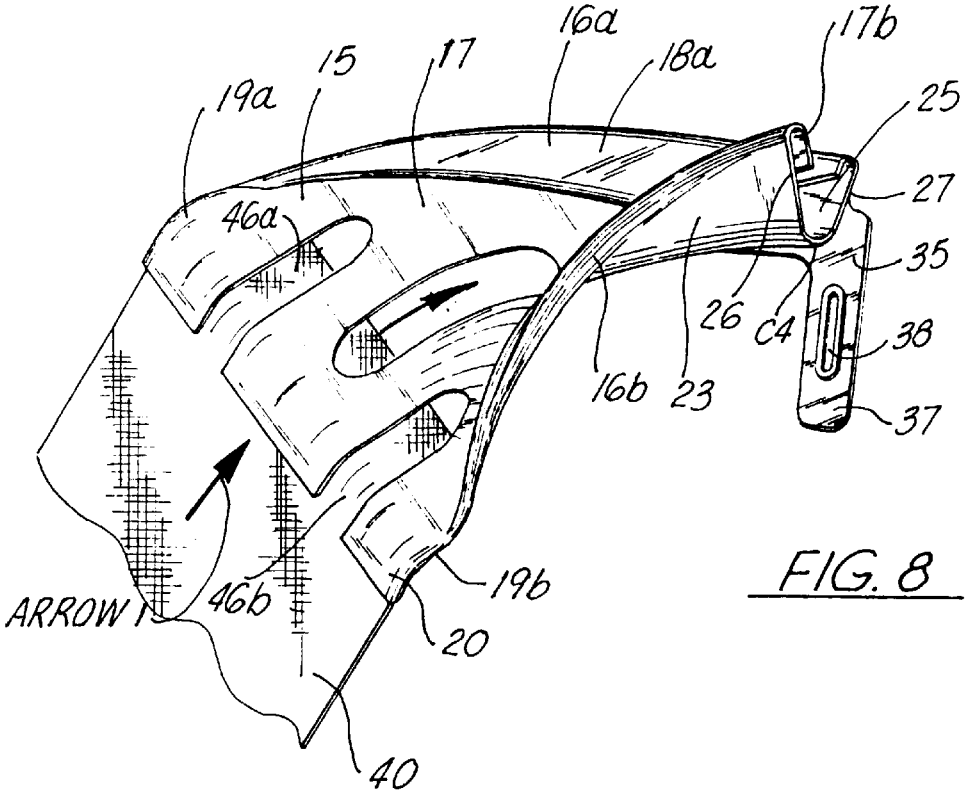
FIG. 8 illustrates my bias binder sewing aid for sewing machines having the perspective view of FIG. 7 and having fabric partially inserted therein

Fabric 40 is fed into inlet port 20 through fabric folding conduit 15 via at least one manual feeding channel 30, as best seen in FIG. 8. Fabric 40 exits fabric folding conduit 15 via outlet port 25, as best seen in FIG. 9. Thereafter, the exiting folded fabric 40 can be readily sewn to unfinished edge 55 of garment, quilt or the like 50, as shown in FIG. 10.

Figure 3:
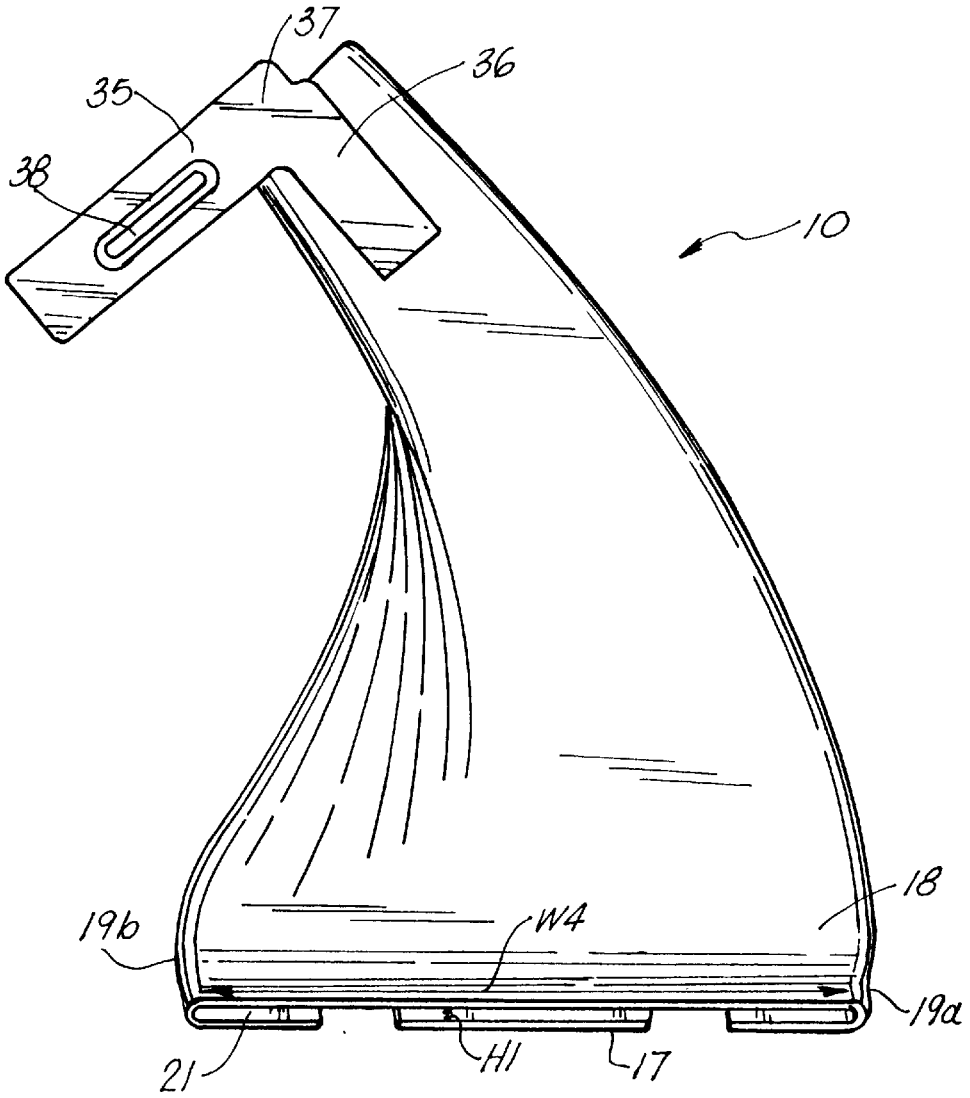
FIG. 3 is a bottom plan view of the preferred embodiment of my bias binder sewing aid for sewing machines, of the present invention.
Figure 5:
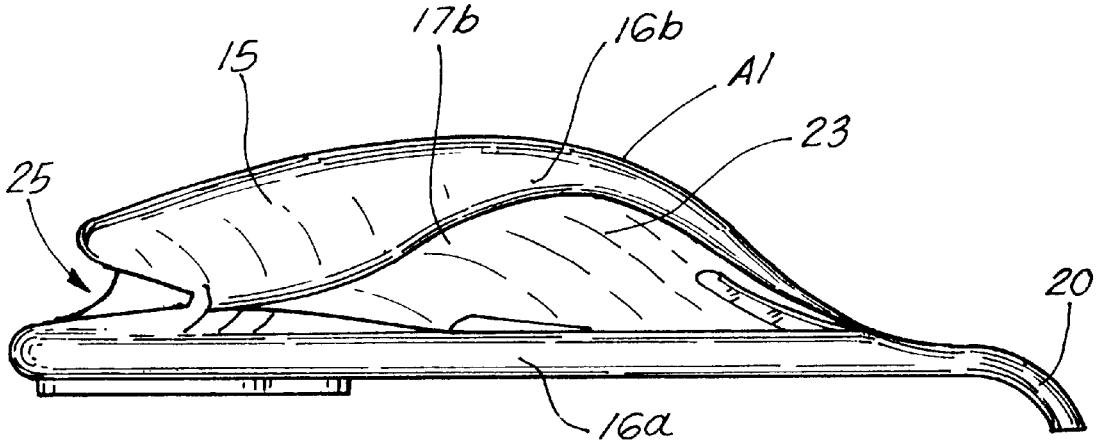
FIG. 5 is a left side elevational view of the embodiment of FIG. 1.
Figure 6:
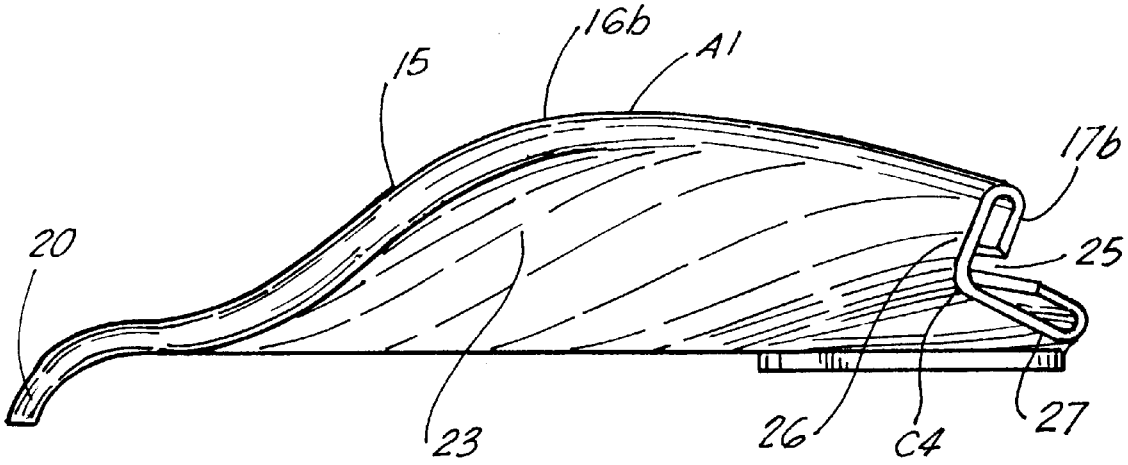
FIG. 6 is a right side elevational view of the embodiment of FIG. 1.

Referring to FIGS. 3 and 5–6, inlet port 20 has an elongated narrow opening 21 having a width W4, defined by the distance between first side 19*a* and second side 19*b*, capable of accommodating therein fabric 40 having width W1. Said elongated narrow opening further has an interior channel height H1 defined by the distance between top surface 17 and bottom surface 18. Interior channel height H1 should be sufficient to allow for the thickness of fabric 40 (unfolded) to pass through inlet port 20 and into fabric folding conduit 15 unhindered. Moreover, interior channel height H1 is substantially maintained through fabric folding conduit 15 and outlet port 25 to prevent obstructing the feeding of fabric 40. Inlet port 20 defines an inlet channel which is curved, as best seen in FIGS. 5 and 6, wherein elongated narrow opening 21 receives fabric 40 in a somewhat vertical plane. Said inlet channel junctures with fabric folding conduit 15 wherein the beginning of fabric folding conduit 15 is flush with the horizontal planes Moreover, fabric folding conduit 15 maintains at least a portion thereof always substantially flush with the horizontal plane, best seen in FIGS. 5 and 6.

The beginning of fabric folding conduit 15 is an elongated narrow opening flush with the horizontal plane and has a width W4, defined by the distance between first side 19*a* and second side 19*b*, capable of accommodating therein fabric 40 having width W1. The elongated narrow opening of fabric folding conduit 15 also has an interior channel height H1 defined by the distance between top surface 17 and bottom surface 18.

In the preferred embodiment, the elongated narrow opening flush with the horizontal plane extends for a short distance. Thereafter, left and right channel sides 16*a* and 16*b* of fabric folding conduit 15 begin to continuously curve inward toward center C4 of fabric folding conduit 15 such that top surface 17 overlaps upon itself. As left and right channel sides 16*a* and 16*b* continuously curve inward, bottom surface 18 becomes top surfaces 18*a* and 18*b* of channel sides 16*a* and 16*b*, respectively and top surface 17 becomes bottom surfaces (only 17*b* shown) of channel sides 16*a* and 16*b*, respectively. Furthermore, as left and right channel sides 16*a* and 16*b* continuously curve inward, the distance between interior channel height H1 is substantially maintained between the top surface and bottom surface 18*a* of left channel side 16*a* and top surface 17*b* and bottom surface 18*b* of right channel side 16*b* to prevent obstructing the feeding of fabric 40.

As left channel side 16*a* continuously curves inward toward center C4, top surface 17 overlaps upon itself such that top surface 17 becomes substantially parallel with itself, as best seen in FIG. 5. Moreover, as left channel side 16*a* continuously curves inward, the width of left channel side 16*a* continuously widens. As left channel side 16*a* widens, top surface 18*a* widens equally.

Figure 2:
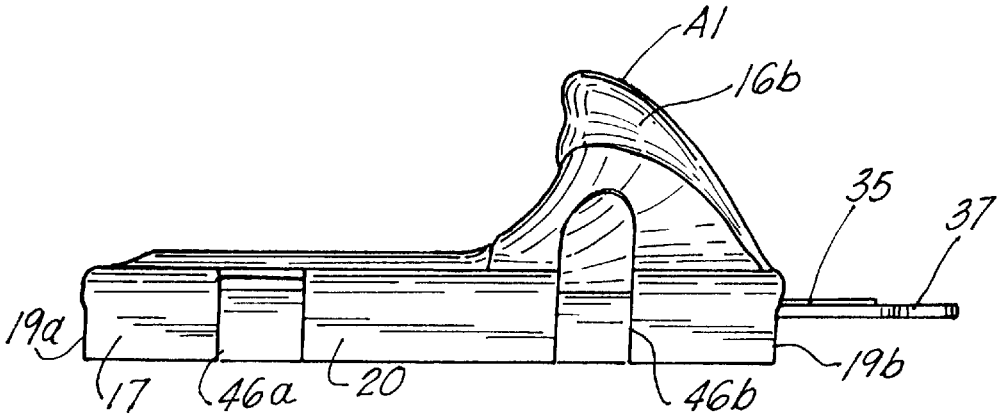
FIG. 2 is a front elevational view of the embodiment of FIG. 1.

As right channel side 16*b* continuously curves inward toward center C4, the portion of fabric folding conduit 15 to the right of center C4, beginning with the edge of side 19*b*, proceeds to continuously rise above the horizontal plane while simultaneously continuously curving to overlap upon top surface 17 thereby forming overlapping wall 23, as seen in FIGS. 2 and 40 As right channel side 16*b* continuously rises above the horizontal plane and simultaneously continuously curve, the width of right channel side 16*b* widens. Overlapping wall 23 peaks at apex A1. Thereafter, overlapping wall 23 while continuously widening, proceeds to decrease in height such that overlapping wall 23 increases the amount of overlap over left channel side 16*a*. As overlapping wall 23 overlaps over left channel side 16*a*, an acute angle between right channel side 16*b* and left channel side 16*a* is formed.

Figure 4:
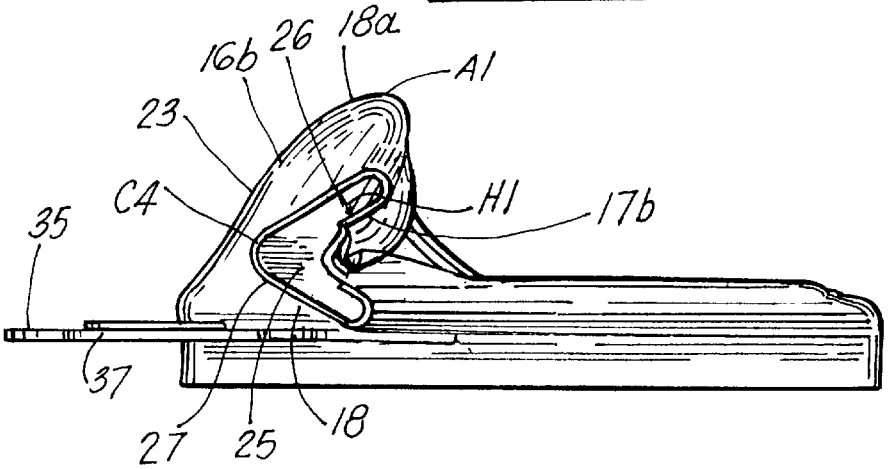
FIG. 4 is a rear elevational view of the embodiment of FIG. 1.

As overlapping wall 23 overlaps over left channel side 16*a*, center C4 of fabric folding conduit is continuously rotated from the horizontal plane to the vertical plane, as best seen in FIG. 4. As center C4 is continuously rotated from the horizontal plane to the vertical plane, bottom surface 18 to the left of center C4 becomes sloped.

Outlet port 25 comprises a V-shaped channel having first port wall 26 and second port wall 27 wherein one distal end of first port wall 26 and second port wall 27 juncture at center C4. First port wall and second port wall 27 are substantially the same length and separated by an acute angle. The other distal end of first port wall 26 and second port wall 27 curve inward while maintaining interior channel height H1.

As best seen in FIG. 10, the widened left channel side 16*a* provides a support ledge for unfinished edge 55 as folded fabric 40 exits outlet port 25. The folded sides of fabric 40 defines a V-shaped fabric conduit for receiving therein unfinished edge 55 of garment, quilt or the like 50.

Top surface 17 has formed therein at least one manual feeding channel 30. At least one manual feeding channel 30 is an elliptical aperture centrally formed in top surface 17 wherein said elliptical aperture is capable of receiving therein the middle finger to stroke fabric 40 in the direction of ARROW 1, shown in FIG. 8.

In the preferred embodiment there at three manual feeding channels. Parallel feeding channels 46*a* and 46*b* are elliptical apertures, having one end thereof truncated, formed in top surface 17 to the left and right, respectively, of at least one manual feeding channel 30. Said one end of parallel feeding channels 46*a* and 46*b* begins at the edge of inlet port 20. Parallel feeding channels 46*a* and 46*b*, preferably receive therein the fore-finger and ring-finger, respectively.

Figure 11:
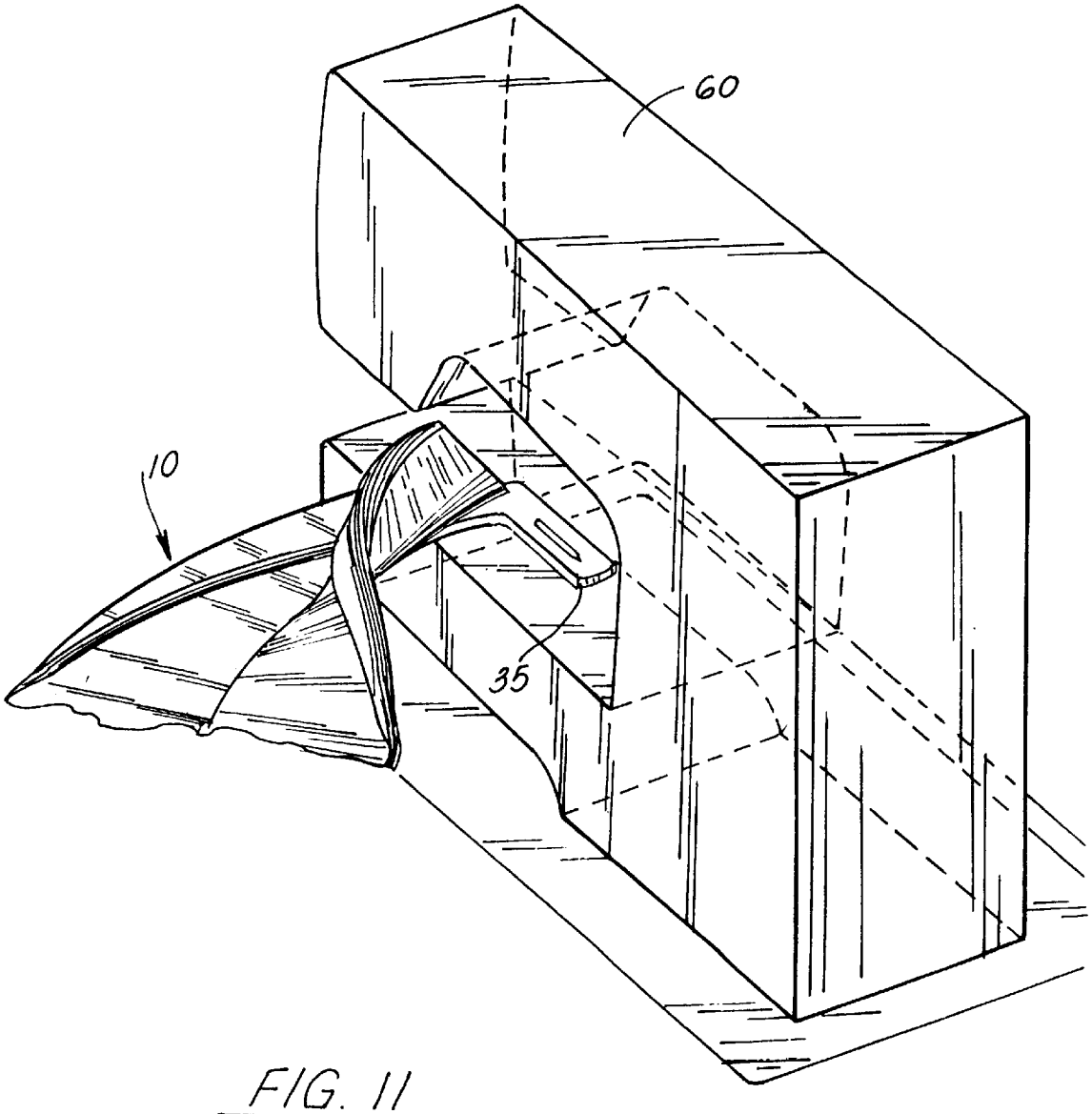
FIG. 11 illustrates my bias binder device affixed to a sewing machine.

Machine attaching means 35 is an L-shaped member comprising first attaching member 36 and second attaching member 37 perpendicular to first attaching member 36. First attaching member 36 is centrally coupled to a horizontally flush portion of bottom surface 18, in close proximity to outlet port 25, along second port wall 27. Second attaching member 37 has formed therein elongated aperture 38 for coupling to sewing machine 60, as best seen in FIG. 11.

In the preferred embodiment, bias binder sewing aid for sewing machines 10 is made of a unitary piece of light-weight material such as, without limitation plastic, or plastic-like material.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. An bias binder sewing aid for folding a piece of fabric having a predetermined width comprising (a) inlet port;

(b) fabric folding conduit, coupled to said inlet port, defined by a top surface and a bottom surface which are parallel and separated by an interior channel height, said fabric folding conduit comprises a left channel side which continuously curves inward toward a center of said fabric folding conduit wherein the width of said left channel side continuously widens toward said center and as said left channel side continuously curves inward, said top surface overlaps upon) itself wherein said top surface becomes substantially parallel with itself;

a right channel side which continuously curves inward toward said center, wherein a right portion of said fabric folding conduit to the right of said center proceeds to continuously rise above a horizontal plane while simultaneously continuously curving to overlap upon said top surface wherein an overlapping wall is formed and wherein as said right channel side continuously rises above the horizontal plane and simultaneously continuously curve, the width of said right channel side widens and said overlapping wall peaks, thereafter said overlapping wall proceeds to decrease in height and increase the amount of overlap over said left channel side; and, (c) an outlet port coupled to an end of said fabric folding conduit.

2. The bias binder sewing aid of claim 1, wherein as said overlapping wall proceeds to decrease in height and increase the amount of overlap over said left channel side, said bottom surface becomes sloped wherein said center is rotated from said horizontal plane to a vertical plane.

3. The bias binder sewing aid of claim 2, wherein said outlet port comprises a V-shaped channel having a first port wall and a second port wall wherein one distal end of said first port wall and said second port wall juncture at said center and are separated by an acute angle.

4. The bias binder sewing aid of claim 1 wherein said inlet port is an elongated narrow opening having a width for accommodating therein said fabric and wherein said elongated narrow opening has an interior port channel height substantially equal to said interior channel height of said fabric folding conduit.

5. The bias binder sewing aid of claim 1, further comprising at least one manual feeding channel, said at least one manual feeding channel is an elliptical aperture centrally formed in said top surface.

6. The bias binder sewing aid of claim 1 further comprising a machine attaching means for securing said fabric folding conduit to a sewing machine.

7. An bias binder sewing aid for folding a piece of fabric having a predetermined width comprising (a) inlet port;

(b) fabric folding conduit, coupled to said inlet port, defined by a top surface and a bottom surface which are parallel and separated by an interior channel height, said fabric folding conduit comprises:

a left channel side which continuously curves inward toward a center of said fabric folding conduit wherein the width of said left channel side continuously widens toward said center and as said left channel side continuously curves inward, said top surface overlaps upon itself wherein said top surface becomes substantially parallel with itself;

a right channel side which continuously curves inward toward said center, wherein a right portion of said fabric folding conduit to the right of said center proceeds to continuously rise above a horizontal plane while simultaneously continuously curving to overlap upon said top surface wherein an overlapping wall is formed, and wherein as said right channel side continuously rises above the horizontal plane and simultaneously continuously curve, the width of said right channel side widens and said overlapping wall peaks, thereafter said overlapping well proceeds to decrease in height and increase the amount of overlap over said left channel side;

(c) an outlet port coupled to an end of said fabric folding conduit; and, (d) at least one manual feeding channel.

8. The bias binder sewing aid of claim 7 wherein as said overlapping wall proceeds to decrease in height and increase the amount of overlap over said left channel side, said bottom surface becomes sloped wherein said center is rotated from said horizontal plane to a vertical plane.

9. The bias binder sewing aid of claim 8 wherein said outlet port comprises a V-shaped channel having a first port wall and a second port wall wherein one distal end of said first port wall and said second port wall juncture at said center and are separated by an acute angle.

10. The bias binder sewing aid of claim 7, wherein said inlet port is an elongated narrow opening having a width for accommodating therein said fabric and wherein said elongated narrow opening has an interior port channel height substantially equal to said interior channel height of said fabric folding conduit.

11. The bias binder sewing aid of claim 7, wherein said at least one manual feeding channel is an elliptical aperture centrally formed in said top surface.

12. The bias binder sewing aid of claim 7, further comprising a machine attaching means for securing said fabric folding conduit to a sewing machine.

13. An bias binder sewing aid for folding a piece of fabric having a predetermined width comprising (a) inlet port which is an elongated narrow opening having a width for accommodating therein said predetermined width of said fabric and wherein said elongated narrow opening has an interior port channel height;

(b) fabric folding conduit, coupled to said inlet port, defined by a top surface and a bottom surface which are parallel and separated by an interior channel height wherein said interior channel height is substantially equal to said interior port channel height of said inlet port, said fabric folding conduit comprises:

a left channel side which continuously curves inward toward a center of said fabric folding conduit wherein the width of said left channel side continuously widens toward said center and as said left channel side continuously curves inwards said top surface overlaps upon itself wherein said top surface becomes substantially parallel with itself;

a right channel side which continuously curves inward toward said centers wherein a right portion of said fabric folding conduit to the right of said center proceeds to continuously rise above a horizontal plane while simultaneously continuously curving to overlap upon said top surface wherein an overlapping wall is formed, and wherein as said right channel side continuously rises above the horizontal plane and simultaneously continuously curves the width of said right channel side widens and said overlapping wall peaks, thereafter said overlapping wall proceeds to decrease in height and increase the amount of overlap over said left channel side;

(c) an outlet port coupled to an end of said fabric folding conduit; and, (d) at least one manual feeding channel.

14. The bias binder sewing aid of claim 13, wherein as said overlapping wall proceeds to decrease in height and increase the amount of overlap over said left channel side, said bottom surface becomes sloped wherein said center is rotated from said horizontal plane to a vertical plane.

15. The bias binder sewing aid of claim 14, wherein said outlet port comprises a V-shaped channel having a first port wall and a second port wall wherein one distal end of said first port wall and said second port wall juncture at said center and are separated by an acute angle.

16. The bias binder sewing aid of claim 13, wherein said at least one manual feeding channel is an elliptical aperture centrally formed in said top surface.

17. The bias binder sewing aid of claim 13 further comprising a machine attaching means for securing said fabric folding conduit to a sewing machine.

* * * * *